US007458770B2

(12) United States Patent
Russo et al.

(10) Patent No.: US 7,458,770 B2
(45) Date of Patent: Dec. 2, 2008

(54) ADJUSTABLE SUPPORT FOR STEAM TURBINE DIAPHRAGMS

(75) Inventors: Thomas Patrick Russo, Galway, NY (US); Kenneth J. Robertson, Broadalbin, NY (US); Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 301 days.

(21) Appl. No.: 11/164,603

(22) Filed: Nov. 30, 2005

(65) Prior Publication Data

US 2007/0119174 A1 May 31, 2007

(51) Int. Cl.
*F01D 25/24* (2006.01)

(52) U.S. Cl. ..... 415/126; 415/209.2; 415/213.1

(58) Field of Classification Search ..... 415/209.2, 415/126, 138, 201, 213.1
See application file for complete search history.

(56) References Cited

U.S. PATENT DOCUMENTS 3,861,827 A * 1/1975 Peabody et al. ..... 415/209.2
4,204,803 A * 5/1980 Leger et al. ..... 415/209.2
6,325,596 B1 * 12/2001 Tomko ..... 415/209.2
6,352,405 B1 * 3/2002 Tomko ..... 415/209.2

FOREIGN PATENT DOCUMENTS

| | | |
|---|---|---|
| EP | 1180581 A2 | 2/2002 |
| GB | 1183993 | 4/1970 |
| JP | 10299411 A | 10/1998 |

* cited by examiner

*Primary Examiner*—Hoang M Nguyen
(74) *Attorney, Agent, or Firm*—Sutherland Asbill & Brennan LLP

(57) ABSTRACT

The present invention provides a steam turbine that has upper and lower halves of diaphragm. The steam turbine of the present invention also provides an adjustable support bar attached to at least the upper half or the lower half of the diaphragm. The adjustable support bar of the present invention has a screw therein such that the adjustable support bar can raise or lower the upper half or the lower half of the diaphragm without removing each half of the diaphragm. Also provided are methods for adjusting and supporting a vertical position of the upper half and the lower half of the diaphragm at a horizontal split line in a steam turbine.

20 Claims, 3 Drawing Sheets

ADJUSTABLE SUPPORT FOR STEAM TURBINE DIAPHRAGMS

TECHNICAL FIELD

This present invention relates generally to a steam turbine. More particularly, the present invention relates to a support bar type design for a steam turbine diaphragm.

BACKGROUND OF THE INVENTION

Steam turbine designs generally include static nozzle segments that direct air flow into rotating buckets that are connected to a rotor. In steam turbines, the nozzle (airfoil) construction is typically called a diaphragm stage. The diaphragm is supported vertically by several methods at a horizontal joint. Typically, the vertical supports may be support bars, pins or support screws. Each design has some advantages and disadvantages.

One design may include a pin at or near the horizontal joint. This design typically would be used in low pressure (LP) turbines where there is more accessibility to get at the pin (between the hood and the inner casing). This design generally cannot support as much weight as a typical support bar design. This design also requires that the pin be removed for machining the required adjustment. This design also requires that the diaphragm be supported during this operation. An eccentric pin also could be used but the added complexity may be cost prohibitive.

Another design is a "bolted diaphragm" support bar design that requires the diaphragm be installed for measurement. The diaphragm and rotor then are removed so the support bar can be machined to adjust the vertical position of the diaphragm. The sequence is then repeated to verify the position and repeated again if necessary. The support screw designs can only be used on the smaller high pressure (HP) stages because the weight may be too great on the intermediate pressure (IP) and low pressure (LP) stages. One drawback to the support screw design is that there is not enough space in the diaphragm cross section to allow for bolting the upper half diaphragm to the lower half diaphragm. This non-bolting creates a situation in which a gap is created between the upper and lower half diaphragms at the horizontal split line. This gap causes efficiency losses within the steam turbine.

Therefore, the support bars currently used require the removal of the diaphragm and rotor for adjustment. It may take several shifts or days to adjust, as both the diaphragm and the rotor must be removed to make the adjustment. Also, support screw designs are used for smaller HP stages where the weight is low enough to allow the design to work. The support screw concept does not allow for bolting the upper and lower half diaphragms, which is desirable.

Therefore, there is a need for a support bar type design that has the ability to support the diaphragm of the steam turbine, and be adjusted quickly without modification to the hardware.

SUMMARY OF THE INVENTION

The present invention provides a steam turbine that comprises upper and lower halves of a diaphragm. The steam turbine also comprises an adjustable support bar attached to at least the upper half or the lower half of the diaphragm. The adjustable support bar of the present invention further comprises a screw therein such that the adjustable support bar can raise or lower the upper half or the lower half of the diaphragm without removing each half of the diaphragm. In one of the preferred embodiments, the adjustable support bar of the present invention comprises an adjustable screw that is capable of being rotated to lift or lower the upper or the lower half of the diaphragm so that the upper half diaphragm is bolted to the lower half diaphragm, and no gap is created between the upper and lower half diaphragms at the horizontal split line.

In another preferred embodiment, the adjustable support bar of the present invention has an overhanging arm and an aperture. The adjusting screw may be positioned within the aperture, and a wear pad may be positioned about the screw. In the present invention, once the clearance measurements are taken, the adjustable screw is rotated to lift or lower the diaphragms.

The present invention also provides a method for adjusting and supporting a vertical position of an upper half and a lower half of a diaphragm at a horizontal split line in a steam turbine. Such a method comprises attaching an adjustable support bar to each half of the diaphragm; adjusting the adjustable support bar to lift or lower the upper half and/or the lower half of the diaphragm; and locking the adjustable support bar into place.

In one of the preferred embodiments, the adjustable support bar of the present invention comprises a screw that has an external hex or 12-point head. The adjustable support bar also comprises a locking plate. In the present invention, once the final position is achieved, the locking plate is tightened over the adjusting screw head and further locked with a second small bolt. Alternatively, in another preferred embodiment, the adjusting screw has threads and a "staking" such as a locking nut is used near the adjusting screw threads to keep it from coming loose.

The present invention provides an adjustable support bar type design that simplifies the design and significantly reduces the cycle time required to adjust the vertical position of the diaphragm of a steam turbine. The present invention also provides an adjustable support bar for steam turbine diaphragm having the ability to be adjusted quickly and without modification to the hardware. The present invention further provides a method for supporting and adjusting the diaphragm of a steam turbine that could be applied to all diaphragms throughout the HP, IP and LP turbine sections. The present invention may replace the traditional "screw support" used in the HP sections. These and other features of the present invention will become apparent upon review of the following detailed description of the preferred embodiments when taken in conjunction with the drawings and the appended claims.

DETAILED DESCRIPTION OF EXEMPLARY EMBODIMENTS

Figure 1:
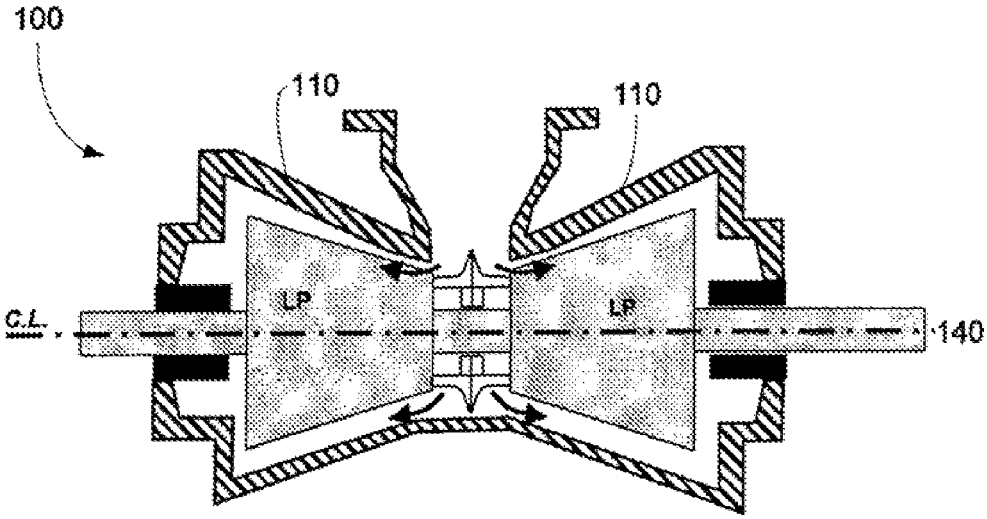
FIG. 1 is a diagram illustrating, inter alia, a side view of a typical two-flow LP steam turbine.
Figure 2:
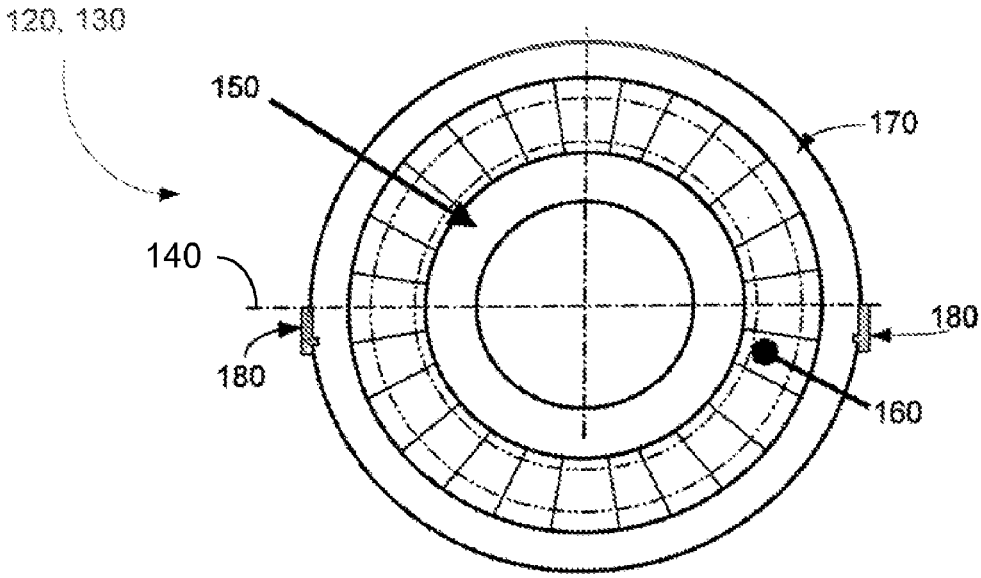
FIG. 2 is a diagram illustrating a front view of a typical diaphragm with web, nozzles, ring and support bars.

Referring now to the figures, where the various numbers represent like parts throughout the several views, FIG. 1 illustrates a side view of a typical two-flow LP steam turbine 100 with a turbine casing 110. The diaphragm having an upper half diaphragm 120 and a lower half diaphragm 130 divided at a horizontal split line 140 is located in a groove(s) in the casing 110, and is not shown in any detail in FIG. 1. The diaphragms 120, 130 represent a nozzle (airfoil) construction in the steam turbine design. FIG. 2 illustrates a typical diaphragm 120, or 130 from a front view of the typical two-flow steam turbine 100. As is known, the diaphragm 120, or 130 may include a web 150, nozzles 160 and a ring 170, in which the nozzles 160 are located in the middle between the web 150 and the ring 170. As is shown, at least two support bars 180 may be bolted to each side of the diaphragm ring 170 to support the diaphragm 120, or 130 vertically. In general, the diaphragm 120, or 130 may be supported vertically by several methods at the horizontal split line 140. Support bars, pins or support screws are typical vertical supports for supporting the diaphragm 120, or 130. Other types of supports also may be used.

Figure 3:
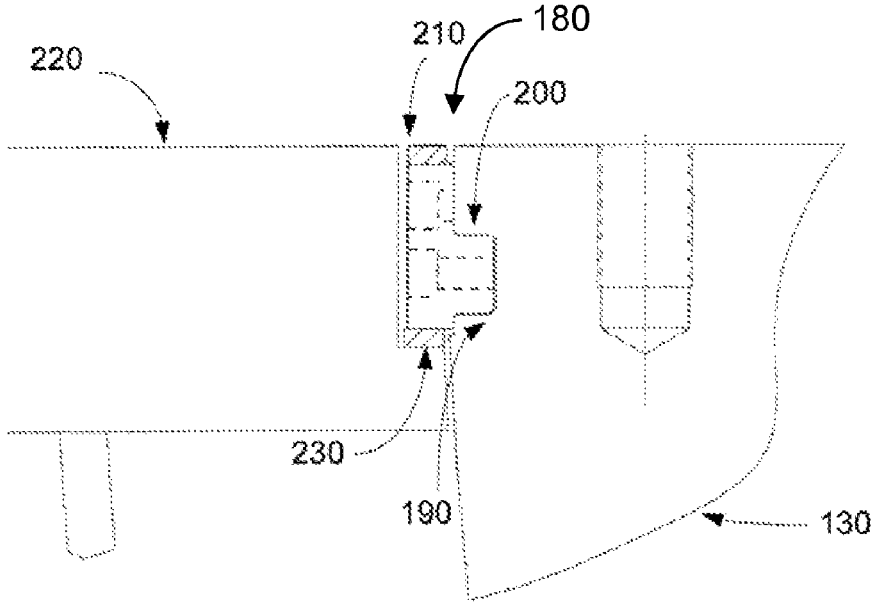
FIG. 3 is a diagram illustrating a two-dimensional front view of a support bar.

FIG. 3 illustrates a two-dimensional front view of a support bar 180 that is bolted to the side of the lower half diaphragm 130. A slot 190 in the diaphragm 130 is created to help support the downward load in sheer. The support bar 180 has an overhanging arm 200 that protrudes over a pocket area 210 in a casing 220 or turbine shell structure (not shown here). FIG. 3 also shows that a shim block 230 may be placed underneath the support bar 180.

However, as provided herein, the support bar 180 is not adjustable. The following FIGS. 4, 5 and 6, illustrate an adjustable support bar 240 of the present invention.

Figure 4:
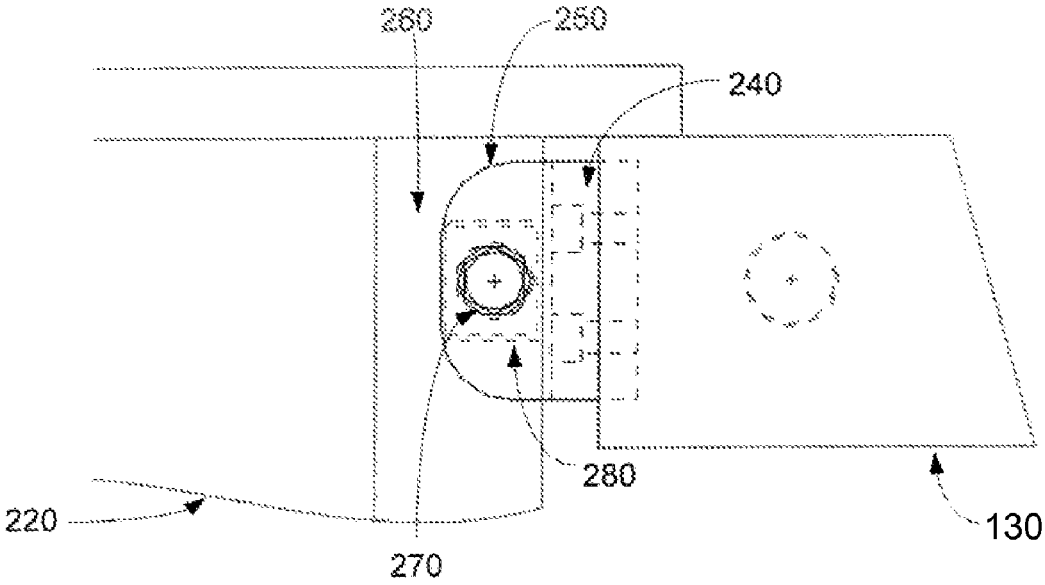
FIG. 4 is a diagram illustrating a two-dimensional top view of a screw support bar of the present invention.
Figure 5:
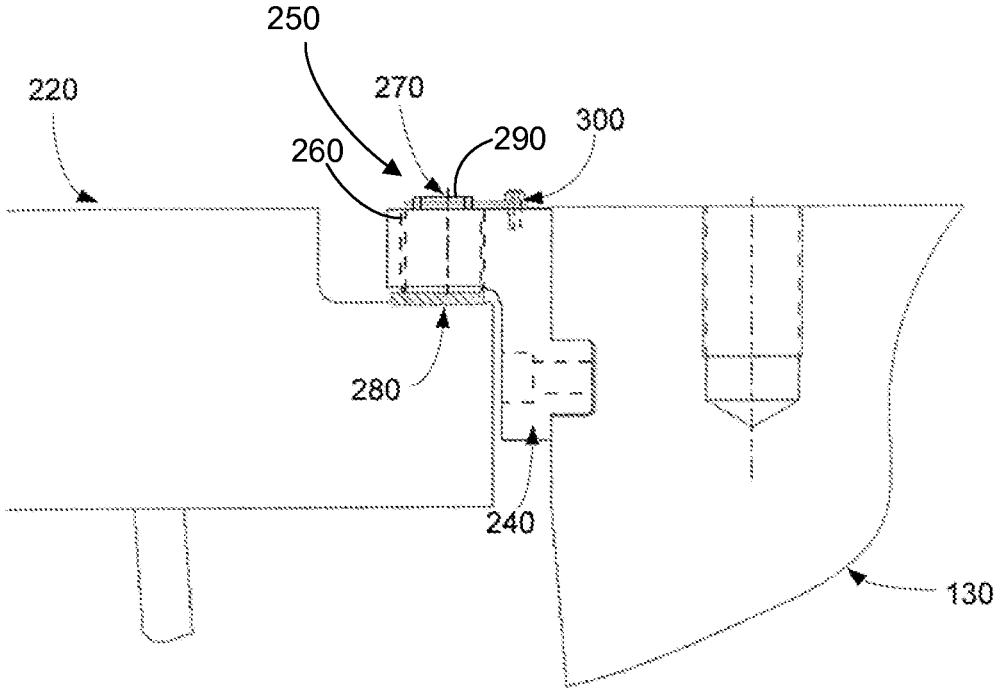
FIG. 5 is a diagram illustrating a two-dimensional front view of a screw support bar of the present invention with a locking plate tightened over an adjusting screw.

FIGS. 4 and 5 show an adjustable support bar 240 as is described herein. The adjustable support bar includes an overhanging arm 250 and an aperture 260. An adjustable screw 270 may be positioned within the aperture 260. A wear pad 280 may be positioned about the screw 270. Once the clearance measurements are taken, the screw 270 may be rotated to lift or lower the diaphragm halves 120, 130 to the desired location without having to remove the diaphragm halves 120, 130.

FIG. 5 further illustrates one of the methods of the present invention to lock the adjusting screw 270 of the adjustable support bar 240 of the present invention to lift or lower the diaphragm halves 120, 130. The adjusting screw 270 illustrated in FIG. 5 may have an external hex or 12-point head 290. Once the final position is achieved, a locking plate 300 may be tightened over the adjusting screw head 290, and locked with a second small bolt.

Figure 6:
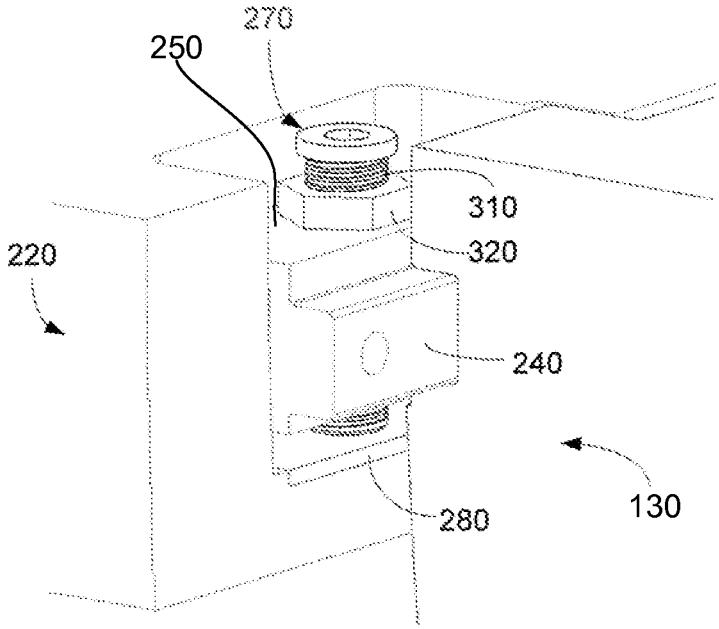
FIG. 6 is a diagram illustrating a screw support bar of the present invention with a locking nut being placed near an adjusting screw threads.

Alternatively, FIG. 6 illustrates another method of the present invention to lock the adjusting screw 270 of the adjustable support bar 240 of the present invention to lift or lower the diaphragm halves 120, 130. The adjusting screw 270 illustrated in FIG. 6 may have threads 310. A locking nut 320 may be used near the adjusting screw threads 310 to keep it from coming loose.

Therefore, the foregoing is considered as illustrative only of the principles of the invention. The features and aspects of the present invention have been described or depicted by way of example only and are therefore not intended to be interpreted as required or essential elements of the invention. It should be understood that the foregoing relates only to certain exemplary embodiments of the invention, and that numerous changes and additions may be made thereto without departing from the spirit and scope of the invention as defined by any appended claims.

What is claimed is:

1. A steam turbine, comprising:

a diaphragm having an upper half and a lower half; and an adjustable support bar attached to the diaphragm;

a threaded aperture formed through the adjustable support bar; and a threaded screw positioned in the threaded aperture, the threaded screw supporting the adjustable support bar against a casing, the threaded screw engaging the threaded aperture such that the adjustable support bar can raise or lower with reference to the casing.

2. The steam turbine of claim 1, wherein the adjustable support bar further comprises an overhanging arm, and wherein the threaded aperture is positioned through the overhanging arm.

3. The steam turbine of claim 1, wherein a wear pad is positioned about screw.

4. The steam turbine of claim 1, wherein the adjustable support bar further comprises a locking plate, and wherein the threaded screw comprises a screw head.

5. The steam turbine of claim 4, wherein the locking plate is tightened over the screw head and is locked with a second small bolt.

6. The steam turbine of claim 1, wherein the adjustable support bar further comprises a locking nut.

7. The steam turbine of claim 6, wherein the locking nut is near the threaded screw to keep the threaded screw from coming loose.

8. A method for adjusting and supporting a vertical position of a diaphragm against a casing, said method comprising:

attaching an adjustable support bar to the diaphragm;

supporting the adjustable support bar above the casing with an adjustable screw, the adjustable screw having screw threads that engage aperture threads on an aperture formed through the adjustable support bar;

adjusting the screw to adjust the position of the diaphragm above the casing; and locking the screw to lock the position of the adjustable support bar.

9. The method of claim 8, wherein locking the screw comprises placing a locking plate over a screw head and tightening the locking plate against the screw head with a second small bolt.

10. The method of claim 8, wherein locking the screw comprises positioning a locking nut near the screw threads to prevent the screw from coming loose.

11. A system for adjustably coupling a diaphragm of a steam turbine to a casing of the steam turbine, the system comprising:

an adjustable support bar associated with the diaphragm; and a screw supporting the adjustable support bar above the casing, the screw engaging an aperture through the support bar, the screw being adjustable to adjust the position of the adjustable support bar above the casing.

12. The system of claim 11, wherein the adjustable support bar further comprises an overhanging arm that is sized and shaped to fit in a pocket area of the casing, the aperture extending through the overhanging arm.

13. The system of claim 11, wherein the adjustable support bar is sized and shaped to mate with a slot in the diaphragm.

14. The system of claim 11, further comprising a locking plate positioned about the screw to limit movement of the screw.

15. The system of claim 14, further comprising a fastener adapted to tighten the locking plate over the screw to limit movement of the screw.

16. The system of claim 14, wherein:

the screw comprises a screw head; and the locking plate is positioned about the screw head.

17. The system of claim 16, further comprising a fastener adapted to tighten the locking plate over the screw head to limit movement of the screw.

18. The system of claim 17, wherein the screw head is at least one of an external hex screw head and a twelve-point screw head.

19. The system of claim 11, further comprising a locking nut positioned about the screw to limit movement of the screw.

20. The system of claim 19, wherein:

the screw comprises threads; and the locking nut is positioned near the threads.

* * * * *